US006772768B2

(12) United States Patent
Xue et al.

(10) Patent No.: US 6,772,768 B2
(45) Date of Patent: Aug. 10, 2004

(54) CIGARETTE FILTERS OF SHAPED MICRO CAVITY FIBERS IMPREGNATED WITH FLAVORANT MATERIALS

(75) Inventors: Lixin Luke Xue, Midlothian, VA (US); Kent Brian Koller, Chesterfield, VA (US); John Bryant Paine, III, Midlothian, VA (US)

(73) Assignee: Philip Morris Incorporated, New York, NY (US)

( * ) Notice: Subject to any disclaimer, the term of this patent is extended or adjusted under 35 U.S.C. 154(b) by 0 days.

(21) Appl. No.: 09/839,760

(22) Filed: Apr. 20, 2001

(65) Prior Publication Data

US 2002/0062833 A1 May 30, 2002

Related U.S. Application Data

(60) Provisional application No. 60/198,627, filed on Apr. 20, 2000.

(51) Int. Cl.[7] ..... A24D 3/04

(52) U.S. Cl. ..... 131/335; 131/341; 131/331; 131/200

(58) Field of Search ..... 131/344, 361, 131/332, 335, 345, 360, 336, 341, 203, 331, 200, 201, 202, 207; 493/39, 47, 50

(56) References Cited

U.S. PATENT DOCUMENTS

| | | | | |
|---|---|---|---|---|
| 4,074,724 A | | 2/1978 | Morie et al. | 131/267 |
| 4,188,960 A | | 2/1980 | Morie et al. | 131/267 |
| 4,280,925 A | | 7/1981 | Kiefer | 252/428 |
| 4,468,845 A | | 9/1984 | Harris | 28/283 |
| 4,729,391 A | * | 3/1988 | Woods et al. | 131/332 |
| 4,858,629 A | | 8/1989 | Cundari | 131/332 |
| 4,917,660 A | | 4/1990 | Spaller, Jr. et al. | 493/42 |
| 4,964,426 A | | 10/1990 | Lee et al. | 131/342 |
| 3,595,137 A | | 7/1991 | Molins et al. | 93/1 C |
| 5,057,368 A | | 10/1991 | Largman et al. | 428/397 |
| 5,133,367 A | * | 7/1992 | Keritsis | 131/198.2 |
| 5,141,006 A | | 8/1992 | Lee et al. | 131/331 |
| 5,150,723 A | | 9/1992 | Lee et al. | 131/342 |
| 5,191,905 A | | 3/1993 | Tsukamoto | 131/332 |
| 5,244,614 A | | 9/1993 | Hagen | 264/78 |
| 5,262,110 A | | 11/1993 | Spaller, Jr. et al. | 264/207 |
| 5,269,996 A | | 12/1993 | Lee et al. | 264/207 |
| 5,275,859 A | | 1/1994 | Phillips et al. | 428/65 |
| 5,356,704 A | | 10/1994 | Phillips et al. | 428/297 |
| 5,423,128 A | | 6/1995 | Moore, Jr. et al. | 33/488 |
| 5,505,888 A | | 4/1996 | Mitchell et al. | 264/138 |
| 5,509,430 A | | 4/1996 | Berger | 131/341 |
| 5,512,230 A | | 4/1996 | Cannon, III | 264/169 |
| 5,599,858 A | | 2/1997 | Buchanan et al. | 524/41 |
| 5,662,773 A | | 9/1997 | Frederick et al. | 162/4 |
| 5,704,966 A | | 1/1998 | Rohrbach et al. | 95/170 |
| 5,713,971 A | | 2/1998 | Rohrbach et al. | 55/233 |
| 5,744,236 A | | 4/1998 | Rohrbach et al. | 428/372 |
| 5,779,736 A | | 7/1998 | Frederick et al. | 8/130 |
| 5,902,384 A | | 5/1999 | Rohrbach et al. | 96/296 |
| 5,922,451 A | | 7/1999 | Cox et al. | 428/323 |
| 5,947,126 A | | 9/1999 | Wilson et al. | 131/331 |
| 5,951,744 A | | 9/1999 | Rohrbach et al. | 96/154 |
| 5,970,988 A | | 10/1999 | Buchanan et al. | 131/332 |
| 6,133,439 A | | 10/2000 | Buchanan et al. | 536/32 |
| 6,209,547 B1 | | 4/2001 | Koller et al. | 131/331 |

OTHER PUBLICATIONS

Xue et al., "Highly Efficient Acid–Gas Removing Shaped Fiber Filters" *Fundamental and Applied Aspects of Chemically Modified Surfaces*: The Royal Society of Chemistry; Ed. by C. Little and J. Blitz; P. 154 (1999).

* cited by examiner

*Primary Examiner*—Dionne A. Walls
(74) *Attorney, Agent, or Firm*—Connolly Bove Lodge & Hutz LLP

(57) ABSTRACT

Tobacco flavorants loaded into semi-open micro cavities of shaped fibers add flavor to tobacco smoke during the smoking process. The shaped fibers are end-capped shaped multilobals that form semi-open cavities between the lobals to effectively entrain solid and liquid flavorant materials. The flavorant material may be in solid particulate forms, such as menthol solids and menthol impregnated carbon or silica gels, and may also be in liquid form such as menthol in dissolved or melt forms.

6 Claims, 1 Drawing Sheet

CIGARETTE FILTERS OF SHAPED MICRO CAVITY FIBERS IMPREGNATED WITH FLAVORANT MATERIALS

RELATED APPLICATIONS

This application claims benefit to provisional application No. 60/198,627 filed in Apr. 20, 2000, which is incorporated by reference in its entirety for all useful purposes.

TECHNICAL FIELD

The present invention relates to cigarette filters of shaped micro cavity fibers impregnated with flavorants that modify the flavor of a smoke stream during the smoking process.

Many types of tobacco smoke modifying agents such as menthol flavorants are added to tobacco products to enhance their taste or compensate for variations in tobacco quality and blend. Currently, flavorants are applied to the tobacco portion or the packaging portion of the cigarettes, which results in only small portion of the flavorant being delivered to the user. In addition, the characteristics of flavorants may change after exposure to the high heat of combustion before reaching the user. There is a strong need for a practical and consistent technology to deliver smoke-modifying agents effectively to the user.

A wide variety of fibrous materials have been employed in tobacco smoke filter elements. Cellulose Acetate ("CA") has long been considered the material of choice for this application. However, the choice of materials has been limited because of the need to balance various commercial requirements A current method for incorporating adsorbent materials in cigarette filters is the physical entrapment of adsorbent particles between CA fibers. The particle size of materials used in such prior art is generally limited in the range of 500 to about 1500 microns in diameter. In order to achieve reasonable product integrity and pressure drop, smaller particles could not be used in this design. In addition, the adsorbents were found to lose activity from exposure to triacetin, a plasticizer used as a binder for the CA fibers.

In order to keep the pressure drop through the filter within acceptable limits, coarse granulated materials in the size of about 10 to about 60 mesh are generally used. A longer shelf life of the adsorbent was achieved, but the efficiency of the filters was limited by the relatively large particle size used. Finer size adsorbent particles with shorter internal diffusive paths and higher effective surface areas cannot be used directly in this configuration due to excessive pressure drop.

Smaller particle size adsorbent/absorbent materials generally have enhanced kinetics of reaction with gas phase components because of their shorter diffusion paths to the interior surface area of such porous materials and the interior body of such absorbent materials. CA fibers currently in use have round or open X or Y cross sections that had carbon dropped in the space, but the cross sections cannot mechanically hold small adsorbent/absorbent particles in place. It was known that employing smaller absorbent particles with shorter diffusion paths can form filters with improved kinetics and capacity for gas phase filtration applications.

It has been found that a fiber with open or semi-open micro cavities is desirable for holding the adsorbent/absorbent material and the flavorant in place. The term "semi-open cavities" as used herein means cavities that possess openings smaller in dimension than the internal volume of the fiber in which they are formed, and that possess the ability to entrap solid fine particles in their internal volume. The term "open cavities" means the opening is the same or bigger in dimension than the internal volume of the fiber in which they are formed.

U.S. Pat. No. 5,509,430 which is incorporated by reference in its entirety for all useful purposes including all drawings relates to polymeric bicomponent fibers and to the production of tobacco smoke filters from bicomponent fibers comprising a core of a low cost, high strength, thermoplastic polymer and a bondable sheath of a material. There is a need to develop an improved filter that has better efficiency in selectively removing or reducing undesired components from mainstream cigarette smoke stream.

U.S. Pat. No. 5,191,905 issued to Berger, which is incorporated by reference in its entirety for all useful purposes including all the drawings describes a cigarette filter. The cigarette filter has a filter chip integrally joined to the cigarette section. The filter chip is formed by combining in a bundle, at least one absorptive synthetic fiber selected from the group consisting of (1) graft polymer fibers produced from irradiated polypropylene reacted with vapor phase styrene and containing adsorptive functional groups, (2) activated carbon fibers, (3) charged electret fibers and (4) magnetic plastic fibers and then chopping the combined fibers to a predetermined length. However, Berger does not teach that the fibers (1) have micro-cavities and (2) that the carbon is loaded in the micro-cavities.

To increase the delivery efficiency, efforts have been made to apply flavorants directly to the cigarette filter. However, limitations have rendered their commercialization unpractical. In U.S. Pat. No. 5,356,704, PET fibers that possess axially oriented open grooves spontaneously wettable by water or hexane are used in the outer layer of cigarette filters to enhance the delivery of flavorant in a liquid state. However, the open structure of the grooves limits the capability of the fibers in retaining flavorant components that may be in solid, semi-solid or liquid phase. For example, fibers made of polymers such as polypropylene have open structures, which are impermeable and not wettable by menthol flavorants and therefore do not satisfy the desired end results of flavor delivery.

U.S. Pat. Nos. 5,356,704 and 5,275,859 are assigned on their face to Eastman Chemical Company, and these patents disclose smoke filters. All these patents are incorporated by reference in their entirety for all useful purposes.

The terms "adsorbent" or "absorbent" as used herein are defined to mean that the ability of a material to take in or soak up gas components on the surface thereof or to assimilate such components into the body thereof.

SUMMARY OF THE INVENTION

Accordingly, an object of the present invention is a cigarette filter comprising shaped micro cavity fibers impregnated with a flavorant that effectively and efficiently modifies the flavor of a stream of smoke during the smoking process.

Another object of the present invention is a cigarette filter comprising shaped fibers having semi-open cavities impregnated with flavorants.

Still another object of the present invention is a fiber filter with flavorants having low resistance to airflow while achieving excellent flavor delivery efficiency.

In accordance with the present invention, a cigarette filter comprises shaped multi-lobal fibers with semi-open cavities loaded with adsorbent particles that include flavorants that release flavors into a smoke stream during the smoking process.

BRIEF DESCRIPTION OF THE PATENT DRAWINGS

Novel features and advantages of the present invention in addition to those mentioned above will become apparent to persons of ordinary skill in the art from a reading of the following detailed description in conjunction with the accompanying drawing wherein similar reference characters refer to similar parts and in which.

DETAILED DESCRIPTION OF THE INVENTION

In the present invention, a novel class of cigarette filters contains fibers with semi-open micro cavities used to mechanically entrap solid or capillary retained liquid smoke modifying agents such as flavorants.

For example. Honeywell U.S. Pat. No. 5,057,368, which is incorporated by reference in its entirety including all the drawings for all useful purposes describes shaped micro cavity fibers that are multilobal such as trilobal or quadrilobal. Other Honeywell United States patents which disclose fibers which are incorporated by reference in their entireties including the drawings are: U.S. Pat. Nos. 5,902,384; 5,744,236; 5,704,966; 5,713,971; and U.S. Pat. No. 5,057,368. In addition, U.S. Pat. Nos. 5,244,614 and 4,858,629 also disclose multilobal fibers and are incorporated by reference in its entirety for all useful purposes. There is no disclosure or suggestion in these patents that these fibers can be used in cigarette filters.

The semi-open structure of these multilobal fibers produces a well-defined internal void volume that effectively and efficiently retains both solid and liquid flavorants. The art of impregnating solid and liquid into those semi-open micro cavities is discussed by Xue et al in Highly Efficient Acid-Gas Removing Shaped Fiber Filters, *Fundamental and Applied Aspect of Chemically Modified Surfaces*; The Royal Society of Chemistry; Ed. By C. Little and J. Blitz; P154, 1999, incorporated herein by reference.

Smoke-modifying agents such as menthol in solid powder form or liquid form are effectively retained in the semi-open micro cavities of such fibers and effectively delivered to the user. The smoke modifying agents may also be impregnated with solid fine absorbent particles such as carbon powder. The flavorant is retained in a separated internal volume of the fibers and does not increase the pressure drop of the filters. In Example 2 herein, 40.26 mg of a multilobal fiber can effectively entrap 19.48 mg of ground menthol solid powders. Also, 11.16 mg of menthol-impregnated fiber (containing 3.6 mg menthol) may be included in the space of plug-space-plug filter arrangement. In Example 3, menthol was first impregnated into fine ground carbon powders through a wet process and then the impregnated carbon was loaded into multilobal fibers and incorporated into cigarette filters in a Plug-Space (triad/carbon/menthol) configuration. Menthol delivery per cigarette was shown to be 0.14 to 1.28 mg for those two examples under a standard testing condition. Obviously, the menthol delivery level may be adjusted by total loading of the fibers in the cigarette and menthol in the fibers.

Figure 1:
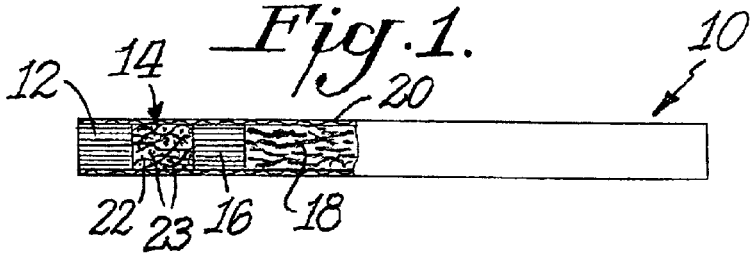
FIG. 1 is a cross-sectional side elevational view of a plug-space-plug (PSP) filter attached to a cigarette, according to the present invention.
Figure 2:
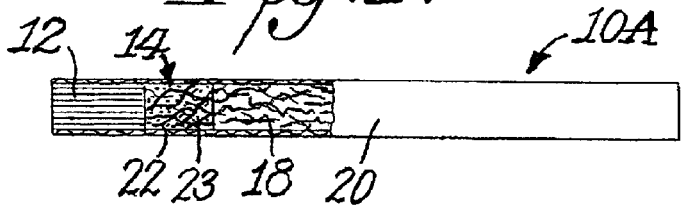
FIG. 2 is a cross-sectional side elevational view of a plug space (PS) filter attached to a cigarette, according to the present invention.

FIGS. 1 and 2 illustrate only two examples of cigarette configurations using flavorant material impregnated shaped fibers, but other configurations may be used.

FIG. 1 is a cross-sectional side elevational view showing a plug/space/plug (PSP) filter attached to a cigarette 10. The cigarette 10 has a downstream plug 12, a space 14 and an upstream plug 16 with the downstream plug 12, space 14 and upstream plug 16 all being connected. The downstream plug 12 may be made of cellulose acetate, and the upstream plug 16 may be the same or different material. Tobacco 18 is shown next to the upstream plug 16. A fiber 22 and an adsorbent 23 combination are inserted in the space 14. Fibers 22 that can be used are multilobal shaped micro cavity fibers such as those fibers described in the background of the invention, preferably, U.S. Pat. Nos. 5,057,368 and 5,509,430 which again are incorporated by reference in their entirety for all useful purposes. These fibers 22 are most preferably the fibers shown in FIGS. 3 and 4 and are Honeywell's Triad fibers made from polypropylene and have an internal void fractional volume 0.5–0.6 and can mechanically entrap fine particles inside its micro cavity channels.

Other polymeric materials, such as, but not limited to polyester, cellulose acetate and polysulfone may also be used to replaced poly propylene in micro cavity fibers for use in this invention. The semi-opened micro-cavities as defined here do not have to he as continuous as Triad fibers. Other shaped fibers such as porous fibers with less continuous semi-open micro-cavities can also be used. The flavorant material impregnated fibers as defined herein may be included in any part of the cigarette or a accessory smoking device in any possible engineering design that allows the them to be exposed to the smoke stream to reach the effect defined herein.

Flavorant material 23 may be any flavoring compound in pure particulate or liquid form or a supported by adsorbent/absorbent particulate, that has the ability to add flavor to the smoke stream. Examples of such materials include methanol in pure solid powder form, menthol impregnated carbon or silica gel particles, menthol melt liquid or dissolved solutions. The adsorbent 23 is mechanically mixed with the fiber 22. The ratio of adsorbent particles to fiber may be in the range of 1 to about 90% by weight and preferably about 30–50% by weight. These absorbents 23 are mechanically held in the micro cavities of shaped fibers 22. The fibers 22 mixed with the adsorbent 23 are then inserted in the space 14 and packed to a density to achieve the desired result of adding flavorant to the smoke steam during the smoking process. A wrapper 20 encases the tobacco 18, upstream plug 16, the space 14 and fiber 22, flavorant material 23 and the downstream plug 12.

FIG. 2 illustrates another embodiment similar to FIG. 1 except that it is a plug/space (PS) configuration. The cigarette 10A has a downstream plug 12 and a space 14. The fiber 22 and flavorant material 23 are inserted in the space 14.

Other configurations may also function in addition to P/S/P and P/S arrangements. The fiber 22 impregnated with flavorant material 23 may be placed at any location in the cigarette that is exposed to the smoke stream such as at the plug locations 12 and 16 or in an accessory smoking device.

Figure 3:
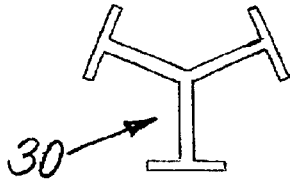
FIG. 3 is an enlarged elevational view of a trilobal shaped fiber with semi-open cavities between the lobals, according to the present invention.
Figure 4:
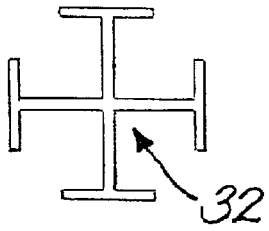
FIG. 4 is an enlarged elevational view of a quadrilobal shaped fiber with semi-open cavities between the lobals, according to the present invention.

FIG. 3 illustrates tri-lobal fibers 30 with semi-open cavities according to the invention. FIG. 4 illustrates quadrilobal fibers 32 with semi-open cavities according to this invention. Again, these fibers are described in U.S. Pat. Nos. 5,057,368 and 5,509,430.

Figure 5:
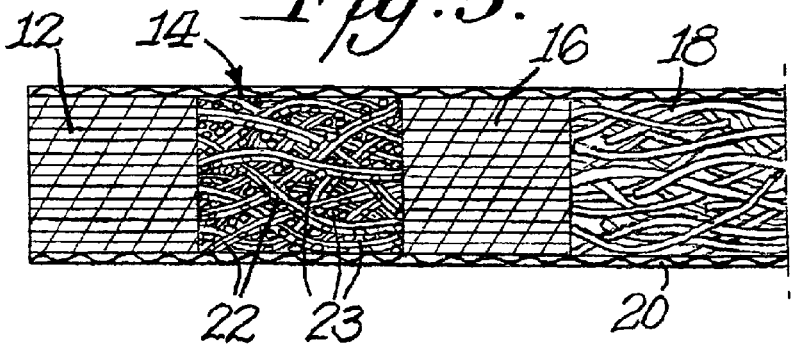
FIG. 5 is an enlarged view of FIG. 1, according to the present invention.

FIG. 5 is an enlargement of FIG. 1 and illustrates the multilobal fibers 22 being combined with fine flavorant delivering particles 23 in a P/S/P configuration.

EXAMPLES

The following examples demonstrate, the spirit and scope of the present invention.

TABLE 1

Data from the Examples

| Example of Cigarette | Filter Configuration | Menthol* Inc. (mg) | Menthol Del. (mg) | TPM (mg) | Puffs | Menthol Del. (mg/Puff) |
|---|---|---|---|---|---|---|
| 1 | P1/S/P2 | 0 | 0 | 12.9 | 6.2 | 0 |
| 2 | P1/S(triad/m | ~3.6 | 0.14 | 11.6 | 6.6 | 0.021 |
| 3 | P2/Triad(Car | ~9.7 | 1.28 | 18.0 | 6.7 | 0.19 |

*Amount may be less due to loss in experimental procedure.

Example 1 was blank #2280 P1/S/P2 reference cigarette.

Example 2 was prepared as follows:

40.3 mg of Triad fiber 3-dpf PP fiber (pre-cut to about 1 inch in length) is mixed and shaken with excess of ground solid powder of 200 mg, Brazilian L-menthol needles in zip sealed polypropylene bags. After removing the excess solid by sieving with a #70 sieve, the fiber weighed 60.11 mg. 11.16 mg of the impregnated fiber was then inserted into the space of #2280 reference cigarette in a P1/triad (menthol)/P2 configuration. The prepared cigarette was sealed in plastic bags and tested in 11 days. The menthol delivery level is 0.14 mg.

Example 3 was prepared as followed:

238.14 mg of above menthol, 463.29 mg of Methanol, and 393.17 mg of Pica coconut carbon dust were mixed and ground under stirring. After most of the methanol solvent was evaporated, the resulted solid (647.65 mg) was further ground to fine powder and transferred into a plastic bag and mixed and shaken with 29.73 mg of above discussed 3-dpf triad fiber. After sieving off excess solid with a #70 sieve, 56.12 mg of impregnated fiber was obtained and inserted into a #2280 cigarette in a P2/Triad (Carbon, menthol) configuration. The sample was then sealed in a plastic bag and tested in 5 days. The menthol delivery level is 1.28 mg.

Shaped fibers with open or semi-surface micro-cavities could be used to prepare improved filters having the flavorant entrapped in the micro-cavities. Their micro-cavities could be used to retain fine absorbent particles such as carbon and APS silica gel powders or mixtures thereof and a flavorant without incurring high RTD. Depending on the surface characteristic of the impregnated solid powders, the removal of gas phase components can be realized via either physical adsorption or chemical reaction mechanism. By selecting the reaction mechanism, certain components of the smoke cigarrette may be selectively removed.

While there is shown and described certain specific structures embodying the invention, it will be manifest to those skilled in the art that various modifications and rearrangements of the parts may be made without departing from the spirit and scope of the underlying inventive concept and that the same is not limited to the particular forms herein shown and described.

What is claimed is:

1. A cigarette comprising:

a tobacco rod; and a filter joined to the tobacco rod, the filter comprising a plug/space configuration comprising:

a space loaded with fiber containing semi-opened micro-cavities, the cavities being loaded with flavorant delivery material in solid or liquid forms; and a plug on at least one end of the space.

2. A cigarette as in claim 1, wherein the fiber is a trilobal fiber.

3. A cigarette as in claim 1, wherein the fiber is a quadrilobal fiber.

4. A cigarette comprising:

a tobacco rod; and a filter joined to the tobacco rod, the filter comprising a plug/space configuration comprising:

a space loaded with fiber containing opened micro-cavities, the cavities being loaded with flavorant delivery material in solid or liquid forms; and a plug on at least one end of the space.

5. A cigarette as in claim 4 wherein the fiber is a trilobal fiber.

6. A cigarette as in claim 4 wherein the fiber is a quadrilobal fiber.

* * * * *

UNITED STATES PATENT AND TRADEMARK OFFICE

CERTIFICATE OF CORRECTION

PATENT NO. : 6,772,768 B2
DATED : August 10, 2004
INVENTOR(S) : Lixin L. Xue et al.

It is certified that error appears in the above-identified patent and that said Letters Patent is hereby corrected as shown below:

Title page,
Item [*] Notice, "0 days" should read -- 4 days --.
Item [56], References Cited, U.S. PATENT DOCUMENTS, insert the following reference:
-- 5,271,419 A 12/1993 Arzonico, et al. 131/365 --.

Signed and Sealed this

Fifteenth Day of March, 2005

JON W. DUDAS
*Director of the United States Patent and Trademark Office*